US008020778B2

(12) United States Patent
Murakami et al.

(10) Patent No.: US 8,020,778 B2
(45) Date of Patent: Sep. 20, 2011

(54) ENVIRONMENTAL APPARATUS CONTROL SYSTEM

(75) Inventors: Yoshifumi Murakami, Ibaraki (JP); Masaaki Terano, Nara (JP); Fumiaki Oobayashi, Osaka (JP); Toshiyuki Miyake, Hirakata (JP); Satoru Kuno, Nagoya (JP); Masayuki Harada, Nagoya (JP)

(73) Assignees: Panasonic Electric Works Co., Ltd., Osaka (JP); National University Corporation Nagoya University, Aichi (JP)

( * ) Notice: Subject to any disclaimer, the term of this patent is extended or adjusted under 35 U.S.C. 154(b) by 696 days.

(21) Appl. No.: 11/883,524

(22) PCT Filed: Jan. 30, 2006

(86) PCT No.: PCT/JP2006/301907

§ 371 (c)(1),
(2), (4) Date: Aug. 1, 2007

(87) PCT Pub. No.: WO2006/082942

PCT Pub. Date: Aug. 10, 2006

(65) Prior Publication Data

US 2008/0116287 A1 May 22, 2008

(30) Foreign Application Priority Data

Feb. 2, 2005 (JP) ..... 2005-026840

(51) Int. Cl.
*F24F 1/00* (2006.01)

(52) U.S. Cl. ..... 236/1 C; 700/277; 700/291

(58) Field of Classification Search ..... 236/1 C; 165/201; 700/276, 277, 278, 299, 291; 705/10
See application file for complete search history.

(56) References Cited

U.S. PATENT DOCUMENTS 5,762,265 A * 6/1998 Kitamura et al. ..... 236/51
6,216,956 B1 4/2001 Ehlers et al.
6,349,883 B1 2/2002 Simmons et al.

(Continued)

FOREIGN PATENT DOCUMENTS

JP 9-105545 A 4/1997

(Continued)

OTHER PUBLICATIONS

International Search Report (PCT/ISA/210) for PCT/2006/301907 dated May 7, 2006 (4 pages).

(Continued)

*Primary Examiner* — Cheryl J Tyler
*Assistant Examiner* — Jonathan Bradford
(74) *Attorney, Agent, or Firm* — Cheng Law Group, PLLC

(57) ABSTRACT

An environmental apparatus control system for a comfortable residential environment based upon demands from the residents. The system includes a project composer which relies upon a first reference (R1) and a second reference (R2) to determine a control project based upon the demands. The references are each determined by a first proportion of the count of the temperature lowering demands in the total number of the residents, and a second proportion of the count of the temperature raising demands in the total number of the resident. A first proportion of the count of the first demands in the number of the residents, and a second proportion of the count of the second demands in the number of the residents are obtained to give a current demand ratio which is compared with first and second references for determination of the control project. The first and second references and are defined respectively as different ratios of the first proportion to the second proportion.

5 Claims, 11 Drawing Sheets

U.S. PATENT DOCUMENTS

2007/0138307 A1* 6/2007 Khoo ..... 236/1 C

FOREIGN PATENT DOCUMENTS

| | | | | |
|---|---|---|---|---|
| JP | 9-269145 | A | | 10/1997 |
| JP | 10-2594 | A | | 1/1998 |
| JP | 2004-205202 | A | | 7/2004 |
| JP | 2004205202 | | * | 7/2004 |

OTHER PUBLICATIONS

Written Opinion of the International Searching Authority (PCT/ISA/237) for PCT/2006/301907 dated May 7, 2006 (5 pages).

Notification of Reasons for Refusal for the Application No. 2005-026840 from Japan Patent Office mailed Oct. 19, 2010.

* cited by examiner

FIG. 6A

*COLLECTED DEMANDS*

| TIME | A | B | C | D |
|---|---|---|---|---|
| 9:58 | -1 | | 0 | |
| 9:59 | | 1 | | |
| 10:00 | | | | |
| 10:01 | | | | 1 |
| 10:02 | | | | |
| 10:03 | | -1 | | |
| 10:04 | | | | |
| ... | | | | |
| ... | | | | |
| 10:57 | | -1 | | 1 |
| 10:58 | | | | |
| 10:59 | | | -1 | |
| 11:00 | -1 | | | |
| 11:01 | | | | |
| 11:02 | | | | |
| 11:03 | | | | 1 |
| 11:04 | | | | |
| 11:05 | | | | |

FIG. 6B

*EFFECTIVE DEMANDS*

| TIME | A | B | C | D |
|---|---|---|---|---|
| 9:58 | -1 | | 0 | |
| 9:59 | -1 | 1 | 0 | |
| 10:00 | -1 | 1 | 0 | |
| 10:01 | -1 | 1 | 0 | 1 |
| 10:02 | -1 | 1 | 0 | 1 |
| 10:03 | -1 | -1 | 0 | 1 |
| 10:04 | -1 | -1 | 0 | 1 |
| ... | -1 | -1 | 0 | 1 |
| ... | -1 | -1 | 0 | 1 |
| 10:57 | -1 | -1 | | 1 |
| 10:58 | | -1 | | 1 |
| 10:59 | | -1 | -1 | 1 |
| 11:00 | -1 | -1 | -1 | 1 |
| 11:01 | | | | 1 |
| 11:02 | | | | 1 |
| 11:03 | | | | 1 |
| 11:04 | | | | 1 |
| 11:05 | | | | 1 |

| TARGET TEMP | AMBIENT TEMP | WARM/ COOL | R1 | R2 |
|---|---|---|---|---|
| 27 | 25-40 | COOL | 75° | 45° |
| 26 | 25-40 | COOL | 60° | 30° |
| 25 | 25-40 | COOL | 45° | 25° |
| ... | | | | |

PRIOR ART

ENVIRONMENTAL APPARATUS CONTROL SYSTEM

TECHNICAL FIELD

The present invention relates to an environmental apparatus control system for control of an environmental apparatus such as air conditioning apparatus.

BACKGROUND ART

There has been an increasing social concern of energy saving due to global warming for controlling environmental apparatus, for example, air conditioning apparatus installed in buildings. BEMS (Building and Energy Management System) is now proposed to optimize energy management in the building. Actually, most of building administrators do not always operate and manage the environmental apparatus properly in view of energy-saving and comfortableness. Especially for temperature control of an enclosed residential space in the building where the comfortableness may conflict with the energy-saving, it has been a common practice to rely solely upon a customary temperature setting and adjust the temperature setting upon request by residents.

Since the temperature control has been made without sufficient consideration of the building characteristics and the resident's preference, the residential space is not always kept at an optimum condition that the residents feel comfort, and even the energy for the air conditioning apparatus may be wasted. Further, the residents may have complaints about that he or she is under the temperature control by the building administrator and is not able to control the environment on his or her own initiative.

In order to cope with the above problem, Japanese Patent Publication No. 2004-205202 proposes a system for controlling the temperature environment in consideration of time-varying resident's preference in combination with the building characteristics. The system is configured to collect residents' demands for the temperature environment on a real-time basis from a communication device, for example, a personal computer belonging to the individual residents, to determine the temperature setting based upon the collected demands, and to control the temperature environment in accordance with the resident's preference as well as the building characteristics representing the temperature difference between the general temperature being monitored at a limited point in the building and the actual temperature at the residential space.

The system is configured to request the residents to submit the environmental demands and to compare the counts of two opposed demands, i.e., "raise temperature" and "lower temperature" in order to obtain a predominant one of the demands by use of a specific algorithm. Then, the system determines a control project of controlling the air-conditioning apparatus in a direction of satisfying the predominant demand. The algorithm in the above system utilizes a first proportion (P1) of the count of the first demand, i.e., temperature lowering demand in the total number of the residents, and a second proportion (P2) of the count of the second demand, i.e., temperature raising demand in the total number of the residents. Then, the algorithm relies upon a 25% rule, as shown in FIG. 11, and returns a result of lowering the temperature when the first proportion (P1) is higher than 25% and at the same time the second proportion (P2) is lower than 25%, i.e., when the first proportion and the second proportion are within a temperature lowering zone as indicated in FIG. 11 by "▼". When, on the other hand, the second proportion (P2) exceeds 25% and the first proportion (P1) is lower than 25%, i.e., the first and second proportions are within a temperature raising zone as indicated by "▲", the algorithm returns the result of raising the temperature. When the first and second proportions (P1, P2) are both lower than 25% or both higher than 25%, i.e., the first and second proportions are within a neutral zone as indicated by "■", the algorithm returns the result of keeping the temperature.

The use of the above algorithm is found satisfactory so long as the neutral zone "■" can be selected. That is, when a response ratio of the added counts of the first and second demands to the total number of the response is higher or lower than 50%, the algorithm can well acknowledge that majority of the residents do not want to raise or lower the temperature. However, for example, when the response ratio is 50%, and both of the first and second proportions are 25%, the algorithm cannot return the result of keeping the temperature. In the situation where the response ratio is around 50%, a slight variation in the first and second proportions results in either of raising and lowering the temperature, while affording no choice of keeping the temperature in consideration of the presence of the residents giving no particular demands or implying to keeping the temperature. Consequently, the system cannot decide to keep the temperature, failing to control the air-conditioning apparatus in consistent with the demands by the residents

DISCLOSURE OF THE INVENTION

In view of the above insufficiency, the present invention has been accomplished to provide an environmental apparatus control system which is capable of making a consistent temperature control for realizing a comfortable residential environment based upon the demands from the residents even in a lowered response ratio of the demands to the total number of the residents. The environmental apparatus control system in accordance with the present invention includes an apparatus configured to control a residential environment, and a demand collector configured to collect demands of changing the residential environments from residents present in the residential environment and to collect the total number of residents present in the residential environment on a regular basis. The demand includes a first demand and a second demand which are opposed to each other. The system also includes a project composer and an apparatus controller. The project composer is configured to determine a control project of controlling the apparatus based upon the demands. The control project is classified into a first project of controlling the apparatus to change the residential environment in one direction, a second project of controlling the apparatus to change the residential environments in the opposite direction, and a neutral project of controlling the apparatus to maintain the residential environments. The apparatus controller is configured to control the apparatus in accordance with one of the projects.

The project composer is configured to have a first reference and a second reference each determined by a first proportion of the count of the first demands in the total number of the residents, and a second proportion of the count of said second demand in said total number of the resident. The first reference and the second reference are different from each other. The project composer is also configured to obtain a current first proportion of the collected count of the first demands in the total number of the residents, and a current second proportion of the collected count of the second demands in the total number of the residents so as to give a current demand ratio of the current first proportion to the current second proportion. The current demand ratio is compared at the project composer with the first and second references so as to select one of the first, second, and neutral projects in accordance with a comparison result.

The feature of the present invention resides in that the first reference is defined by a predetermined first ratio of the first proportion to the second proportion, and the second reference is defined by a predetermined second ratio. Further, the project composer is configured to select the first project when the current demand ratio is above the first reference, to select the second project when the current demand ratio is below the second reference, and to select the neutral project when the current demand ratio is between the first reference and the second reference.

Accordingly, the project composer is given an improved algorithm which is capable of affording a chance of selecting the neutral project over a wide range of the response ratio of the added counts of the first and second demands to the total number of the residents, particularly in the lowered response ratio. Whereby, the system can provide the control project in well reflectance of the count of the active demands as well as the count of no demand from the residents.

Preferably, the project composer is configured to determine a target parameter based upon the selected one of the first, second, and neutral projects. The target parameter is referred to by the apparatus controller for controlling the apparatus to adjust the residential environment in match with the target parameter, and is recorded in a control history table. The project composer is configured to shift at least one of the first reference and the second reference in a direction of reducing a chance of selecting the first project in a next step when the current target parameter is higher than the previous one, and in a direction of reducing a chance of selecting the second project in the next step when the current target parameter is lower than the previous one. Thus, the project composer can acknowledge a trend of varying the environment from the control history table so as to restrain an excessive change of the environment from repeating in the same direction, thereby realizing a moderate environmental control.

Further, the project composer may be configured to have a third reference which is defined by a predetermined first lower limit of the first proportion and a predetermined second lower limit of said second proportion. The third reference is relied upon when the current first proportion is lower than the first limit and at the same time the current second proportion is lower than said second limit so that the project composer selects the neutral project in this situation. Thus, the neutral project can be selected even at the lowered response ratio, thereby assuring a comfortable environmental control in well consideration of that the majority of the residents do not want to change the environment.

Alternatively, the third reference may be defined by one of a predetermined first lower limit of the first proportion and a predetermined second lower limit of the second proportion. The third reference is relied upon by the project composer to give the second project when the current first proportion is lower than said first limit or to give the first project when the current second proportion is lower than said second limit. Thus, the second project or the first project can be made ascendant at the lowered response ratio, which is advantageous for satisfying energy saving requirement by defining the ascendant project as a less-energy consuming project.

Further, the project composer can be configured to provide a temporary proportion set composed of a temporary first proportion and a temporary second proportion each time one of the first and second projects is selected. When the second project is selected, the temporary first proportion is made equal to the previous first proportion and the temporary second proportion is made equal to the previous first proportion. While, on the other hand, when the first project is selected, the temporary first proportion is made equal to the previous second proportion, and the temporary second proportion) is made equal to the previous second proportion. The project composer compares the current first proportion and the current second proportion respectively with those of the corresponding temporary proportion set, and gives a modified proportion set which is a combination of a greater one of the current first proportion and the temporary first proportion, and a greater one of the current second proportions and said temporary second proportion. The modified proportion set is relied upon for selecting one of the first, second, and neutral projects. The temporary first and second proportions are decremented towards zero each time the project composer selects the project. The above arrangement is particularly advantageous when the count of the adopted demands is reset to zero each time the project is determined in favor of the adopted demand. That is, if the count of the adopted demand is reset, the non-adopted demand would be predominant whereby the project composer would select in the next step the project which is opposite to the previous project, failing to continue a consistent control. However, the above arrangement can prevent such incident and assure to give the consistent control while permitting the system to reset the count of the adopted demands.

These and still other advantageous features of the present invention will become more apparent from the following detailed description of the preferred embodiment when taken in conjunction with the attached drawings.

BRIEF DESCRIPTION OF THE DRAWINGS

FIGS. 6A and 6B are respective tables utilized in the above system for processing demands from the residents;

BEST MODE FOR CARRYING OUT THE INVENTION

Figure 1:
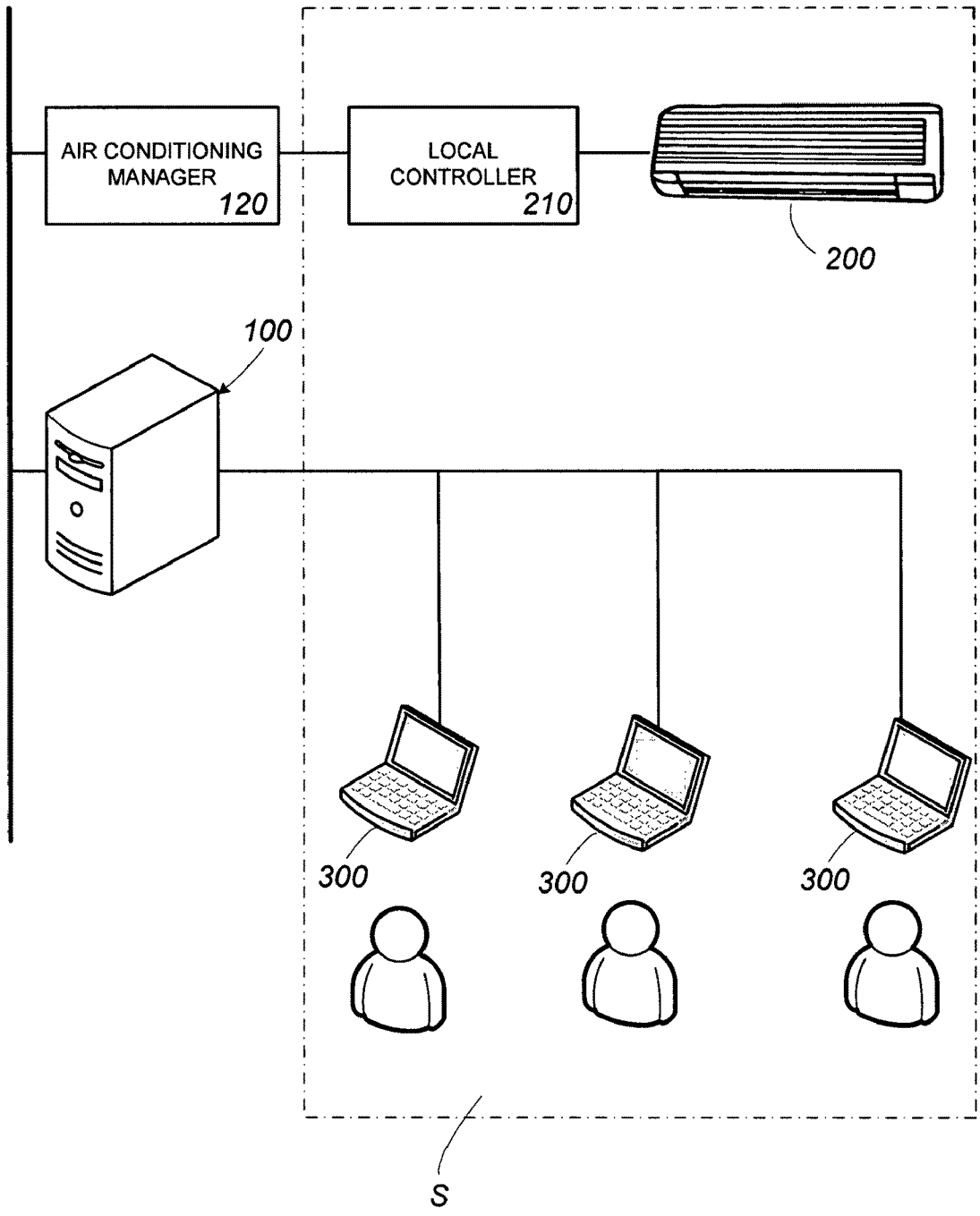
FIG. 1 is a block diagram illustrating an environmental apparatus control system in accordance with a preferred embodiment of the present invention.
Figure 2:
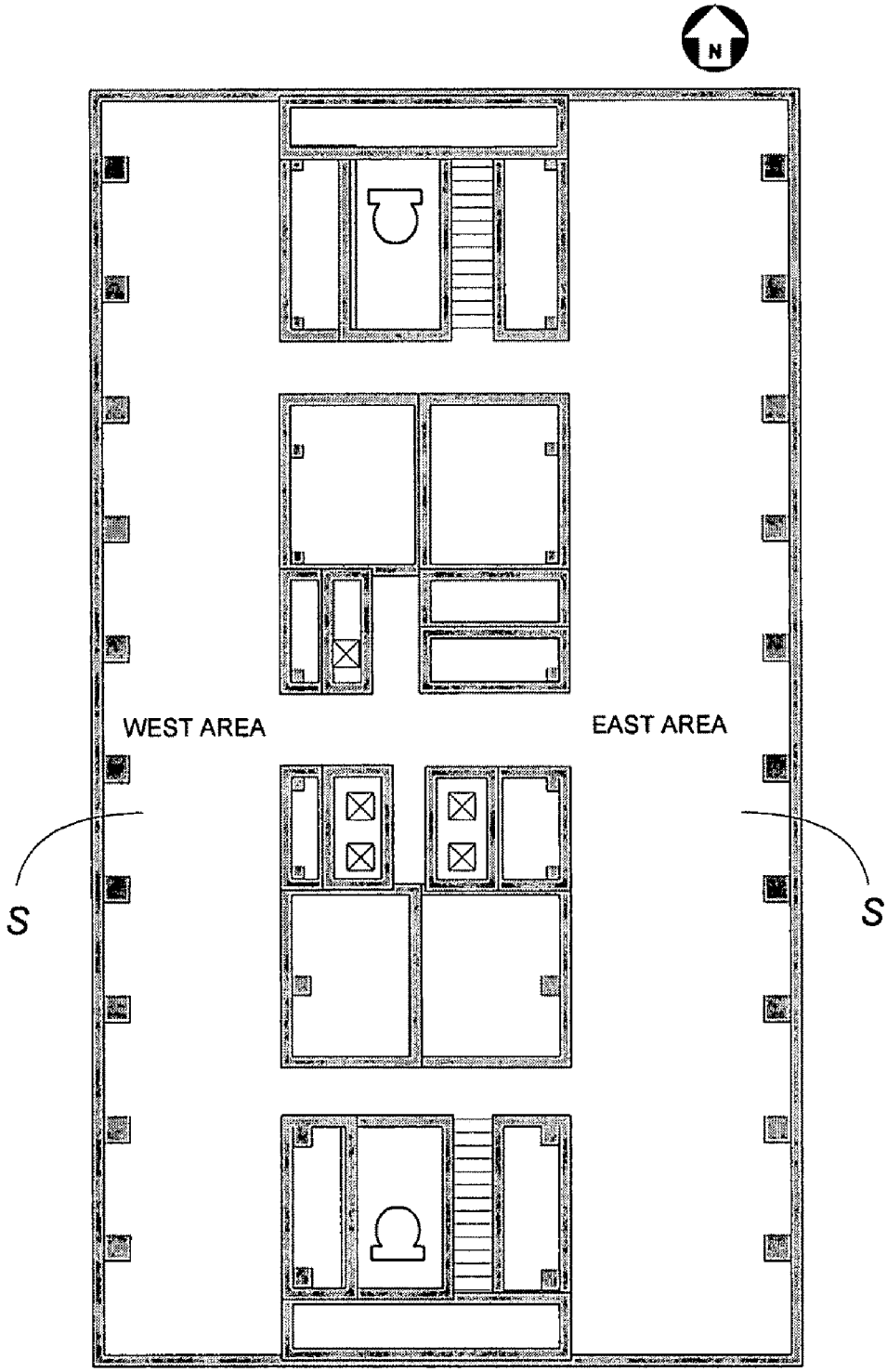
FIG. 2 is a plan view of an environmental space of a building which is controlled by the above system.

Referring now to FIGS. 1 and 2, there is shown an environmental apparatus control system in accordance with a preferred embodiment of the present invention. In the present embodiment, the system is specifically configured to control air-conditioning apparatus 200 for managing a temperature of an enclosed residential space in a building in consideration of demands from residents in the space, although the present invention is not limited thereto. For example, the system is introduced for controlling the environmental temperature of a relatively large space (S) where many residents or persons are present such as office rooms or areas in the building as shown in FIG. 2.

Figure 3:
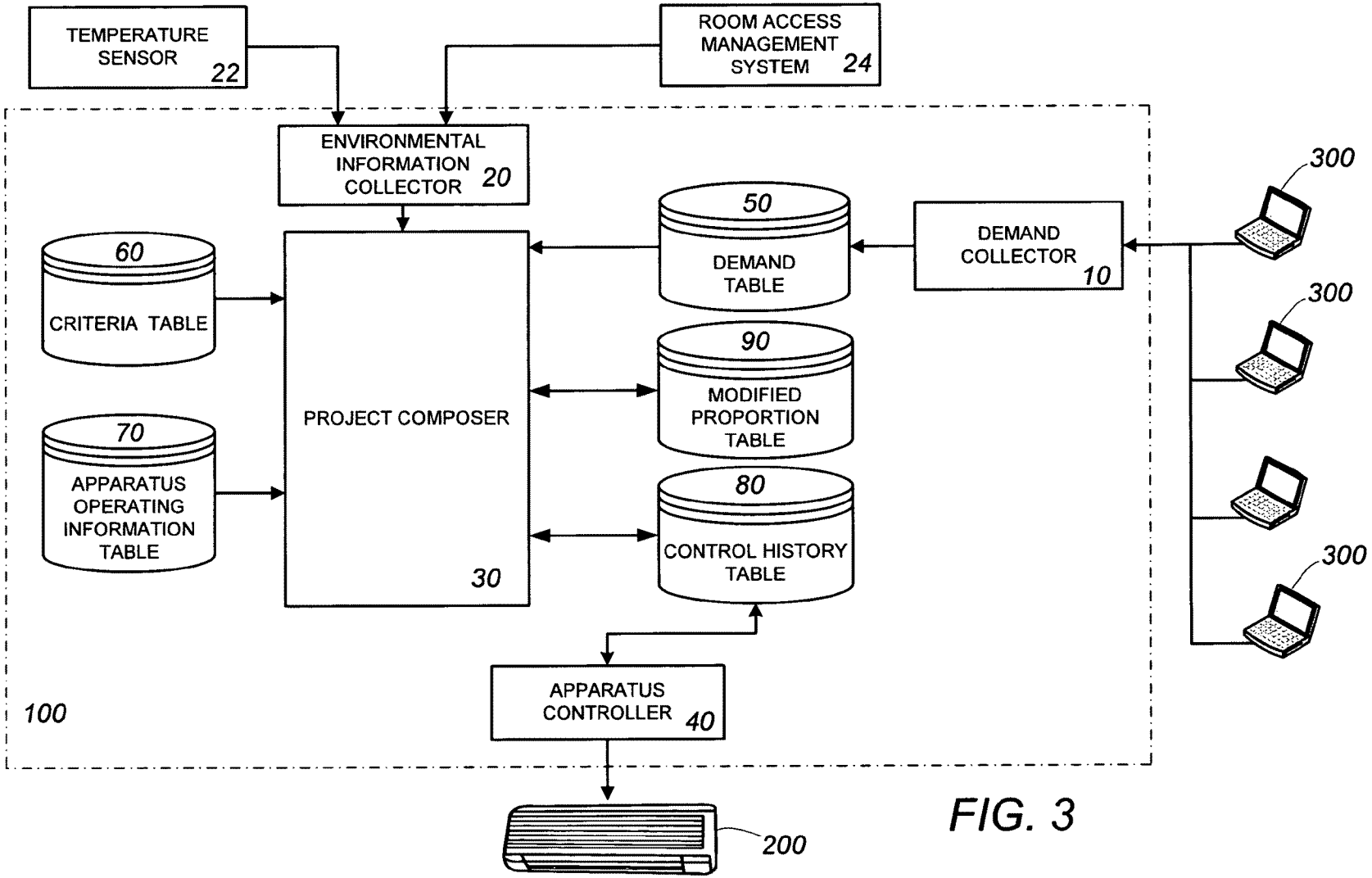
FIG. 3 is a block diagram illustrating a configuration of the above system.
Figure 4:
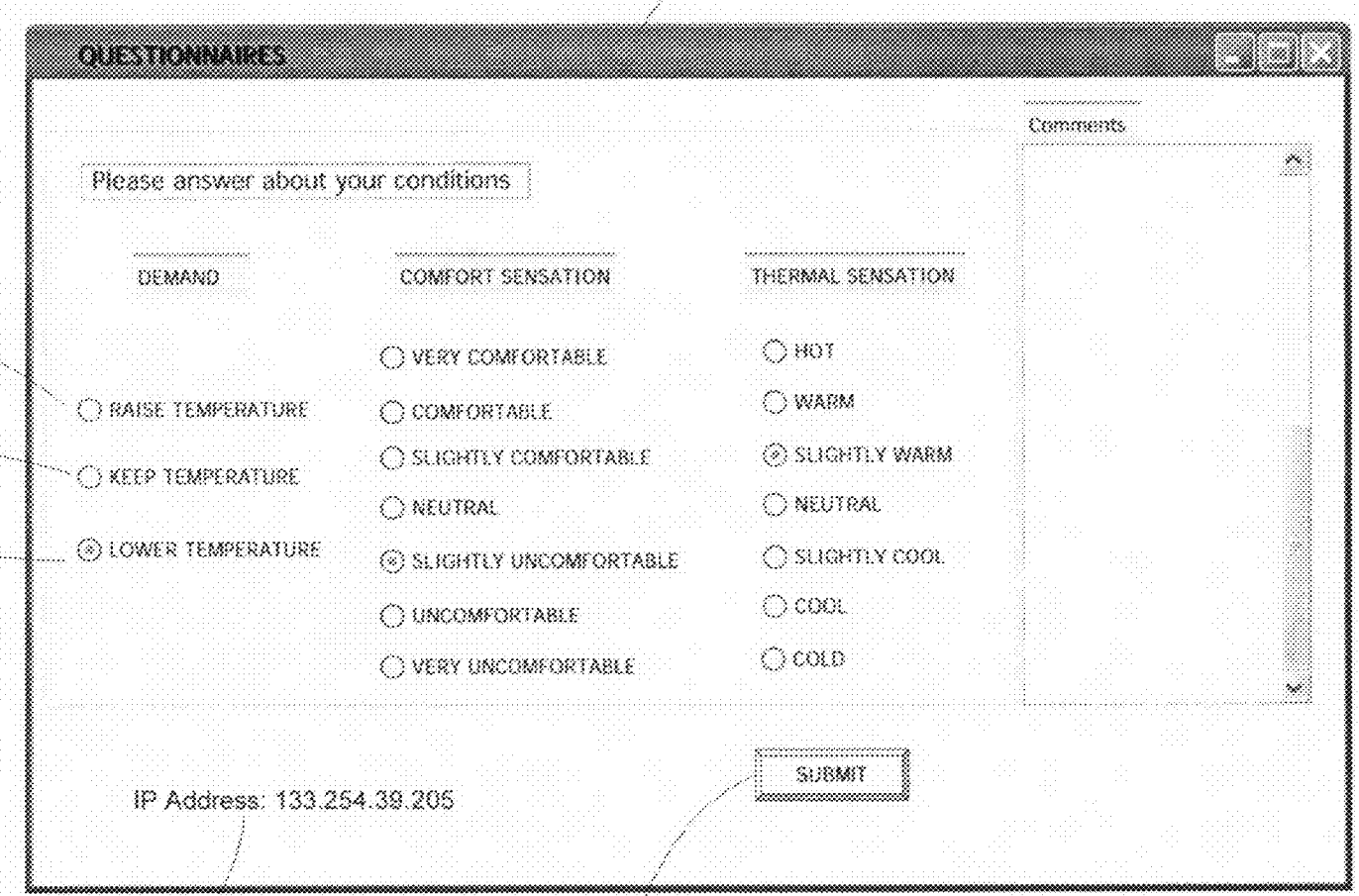
FIG. 4 is a view illustrating an input window form appearing in a personal terminal belonging to each resident in the environmental space.

The system includes a server 100 connected through a network to a plurality of personal terminals 300 such as personal computers respectively belonging to residents in the residential space As shown in FIG. 3, the server 100 is configured to provide functional units which are combined to determine a control project for controlling the air-conditioning apparatus 200 in consideration of the demands of the residents collected through the personal terminals 300. The units basically include a demand collector 10, an environmental information collector 20, a project composer 30, and an apparatus controller 40. The demand controller 10 is configured to collect at regular intervals, for example, 1 minute an identification code or a specific address assigned to each of the terminals 300 and a resident's demand submitted at each terminal 300. For this purpose, each terminal 300 is programmed to generate on its display an input window form 310 as shown in FIG. 4, prompting the resident to submit the demand, i.e., "raise temperature", "keep temperature", or "lower temperature" by selecting one of radio buttons 311, 312, and 313, and pressing a button 314. The input window form 310 also includes a label 316 indicating the address of the terminal 300.

Further, the input window form 310 includes entries of "comfort sensation" and "thermal sensation" each in seven grades, in addition to a text box for receiving a comment by the resident. The respective answers are sent to the sever 100 to be analyzed thereat to create a statistical report to be reviewed by an administrator of the building.

The demand is submitted together with the address of the terminal to the demand collector 10 and is then written into a demand table 50 which is stored in a storage means (not shown) in the server to give time series data of the demands as related to the address of the associated terminal. The address can be utilized to identify the residential space, a location of the terminal in the space, and the associated air-conditioning apparatus 200 by referring to a predetermined relation table in the storage means. The environmental information collector 20 is configured to collect a room temperature from a temperature sensor 22 as well as the number of the residents present in the space from a room access management system 24.

The project composer 30 is configured to determine the control project by analyzing the demands collected from the terminals 300 with reference to criteria stored in a criteria table 60 and also with reference to the operating condition of the air-conditioning apparatus 200 in an apparatus operating information table 70, details of which will be explained later. The control project includes a target temperature to be achieved by the air-conditioning apparatus 200, an operating mode indicative of warming or cooling, and an apparatus index identifying the air-conditioning apparatus. The control project is stored in a control history table 80 which is constantly referred by the apparatus controller 40 so that the apparatus controller 40 retrieves the updated control project in order to create a current temperature management signal. The signal is sent through the network to an air-conditioning manager 120 which distributes the signal to a local controller 210 for the air-conditioning apparatus identified by the control project, as shown in FIG. 1. Upon receiving the signal, the local controller 210 provides a control signal to the air-conditioning apparatus 200 for raising, lowering, or keeping the temperature.

Figure 5:
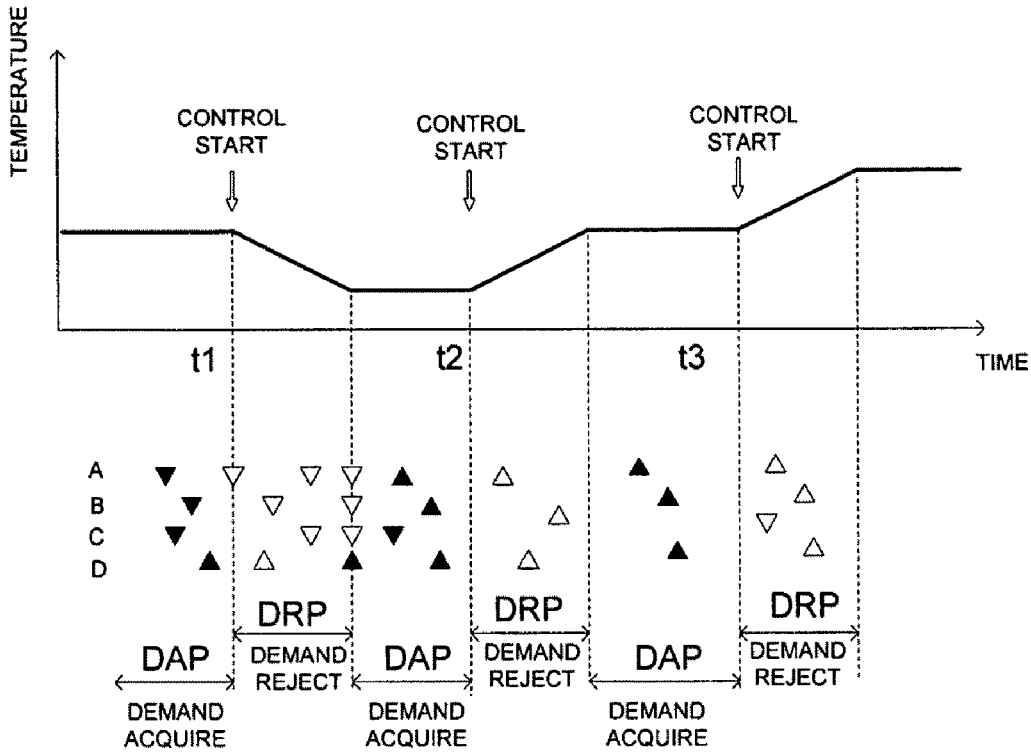
FIG. 5 is a graph illustrating the operation of the above system.

Now, details of determining the control project are discussed with reference to FIGS. 5 to 8. After the environmental information collector 20 collects the number of the residents (step 1 in FIG. 8), the project composer 30 reads the data from the demand table 50 at every one (1) minute to obtain effective demand from each terminal to calculate the count of the residents respectively demanding to raise temperature, to lower temperature, and to keep temperature. The effective demand is defined as a most recent demand from each terminal 300 during an immediately previous demand acquisition period DAP, as shown in FIG. 5, in which the demands respectively from four terminals or residents "A", "B", "C", and "D" are shown for an easy understanding purpose, and the demand of raising temperature and the demand of lowering temperature are respectively indicated by "▲" and "▼". In order to obtain the effective demand, the project composer 30 processes time series data of the collected demands as indicate by a table of FIG. 6A into corresponding time series data as indicated by a table of FIG. 6B in order to decide the kind of the demands from each of the terminal at every 1 minute. In these tables, "1", "0", and "−1" indicate respectively the demands of raising temperature, keeping temperature, and lowering temperature, while a blank cell indicates that no demand or response is made from the corresponding terminal within the immediately previous demand acquisition period DAP. It is noted that the project composer 30 is configured to give a demand rejection period DRP corresponding to a period in which the temperature is varying in accordance with the control project, and during which the project composer 30 is inhibited from making the control project, i.e., refusing the demands. The demand rejection period is expected to be approximately 30 minutes. For example, when the temperature is settled at time t1 (11:00), the project composer 30 reads the effective demands at 11:00 from the table of FIG. 6B, and obtains the respective counts of the demands of raising temperature and lowering the temperature in order to determine the control project with reference to criteria stored in the criteria table 60. It is noted in this connection that the apparatus controller 40 is configured to read the control history table 80 at intervals longer than the cycle (one minute in this instance) at which the control project is determined. In other words, the control project is made at every one minute during the demand acquisition period DAP, i.e., until the apparatus controller 40 reads the control history table 40 to start the corresponding control over the air-conditioning apparatus 200.

Figure 7A:
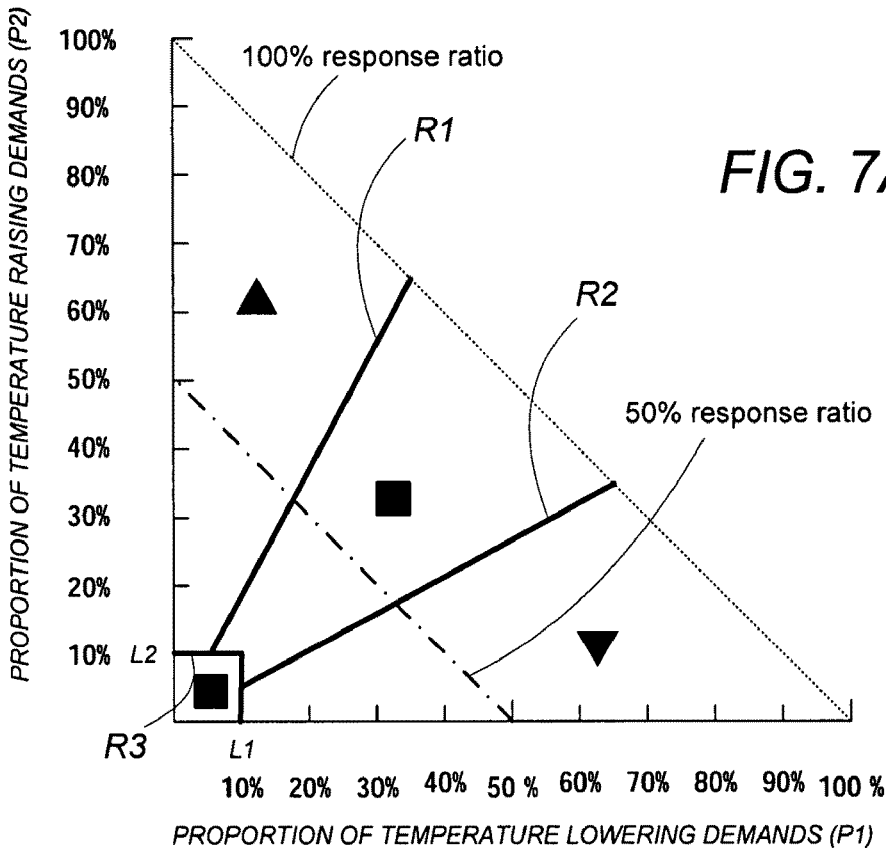
FIGS. 7A and 7B are graphs illustrating a selection of a control project through an analysis of the demands.
Figure 7B:
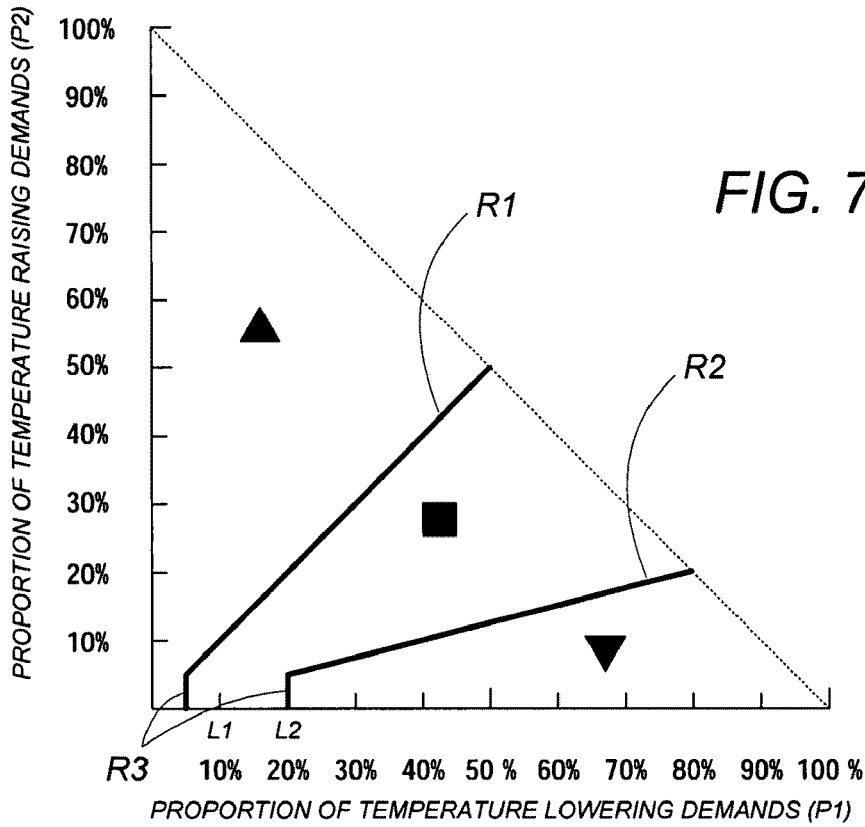

In the present embodiment, the system is configured to provide two types of criteria, one for comfortable control as represented by a graph of in FIG. 7A, and the other for an energy saving oriented control as represented by a graph of FIG. 7B. One of the two criteria is selected by the administrator of the building. Each criterion has a first references R1 and a second reference R2, each being a function of a first proportion (P1) of the count of the temperature lowering demands in the total number of the residents present in the space, and a second proportion (P2) of the count of the temperature raising demands in the total number of the residents. The first and second references R1 and R2 is set to have different coefficients or gradient angles such that a right-angled isosceles triangular area defined by the rectangular coordinates of the first and second proportions (P1 and P2) is divided into three separate zones, namely, a temperature lowering zone "▼", a neutral zone "■", and a temperature raising zone "▲". The comfortable control criteria of FIG. 7A additionally includes a square neutral zone "■" delimited by third reference lines R3 each corresponding to a first lower limit L1 (=10% P1) and a second lower limit L2 (=10% P2). While on the other hand, the energy saving oriented control criteria of FIG. 7B has two additional third references R3 each continuous from each of the first and second references R1 and R2. These two additional third references R3 are defined respectively by the first lower limits L1 (=10% P1) and L2 (=20% P1). The criteria of FIG. 7B is prepared for use in the cooling operating condition, and is found advantageous for energy-saving as the temperature lowering zone "▼" is limited to be above 20% of the first proportion (P1) and the neutral zone "■" is limited to be above the 10% of the first proportion (P1). In case for warming, the lower ends of the first and second references R1 and R2 are respectively defined by the third references R3 of 20% of the second proportion (P2), and 10% of the second proportion (P2).

The gradient angles of the first and second references R1 and R2 are varied depending upon parameters including the current target temperature read from the control history table 80, the operating condition of the air-conditioning apparatus read from the apparatus operating information table 70, and a current ambient temperature being monitored by a temperature sensor. As shown in the below table, the criteria table 60 has a format designating the angles of the first and second references R1 and R2 in relation to different combinations of the current target temperature, the ambient temperature, and the operating condition (warming or cooling) of the apparatus.

| TARGET TEMPERATURE | AMBIENT TEMPERATURE | WARM/COOL | R1 | R2 |
|---|---|---|---|---|
| 27 | 25-40 | COOL | 75° | 45° |
| 26 | 25-40 | COOL | 60° | 30° |
| 25 | 25-40 | COOL | 45° | 25° |
| ... | ... | ... | ... | ... |

Upon receiving these parameters, the project composer 30 takes the first and second references from the criteria table 60 to establish or select a specific criterion (step 2 in FIG. 8) for determining the control project, i.e., raising, lowering or maintaining the temperature based upon the collected demands from the terminals 300. The project composer 30 obtains, based upon the effective demands from the demand table 50, a current first proportion of the count of the temperature raising demands in the total number of the residents present in the space, and a current second proportion of the count of the temperature lowering demands in the total number of the residents present in the space to give a current demand ratio of the current first proportion to the current second proportion (step 3 in FIG. 8). The current demand ratio is analyzed with reference to the selected criterion to determine a temperature variation (ΔT) which is to be added to the current target temperature (step 4 in FIG. 8). For example, when the current demand is within the temperature lowering zone "▼" in the graph of FIG. 7A or FIG. 7B, i.e., the current demand is below the second reference R2, the temperature variation (ΔT) is set to be "−1". When the current demand ratio is in the neutral zone "■", i.e., between the first and second references R1 and R2, or below the third reference R3 in case of FIG. 7A, ΔT=0. When the current demand ratio is in the temperature raising zone "▲", i.e., above the first reference R1, ΔT=1.

Figure 8:
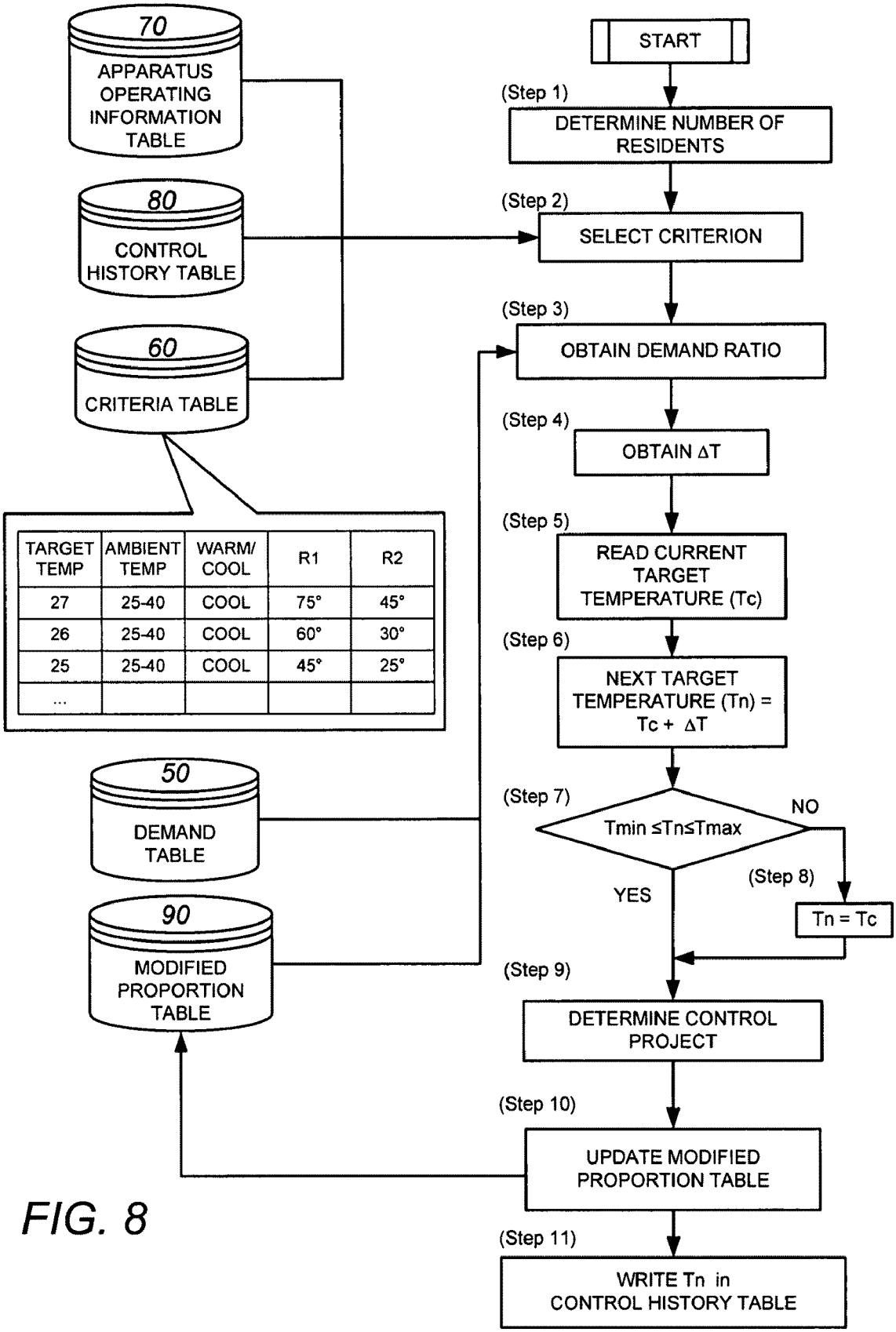
FIG. 8 is a flowchart illustrating the operation of the above system.

Then, the project composer 30 determines a next target temperature (Tn) as the current target temperature (Tc)+ΔT (steps 5 & 6 in FIG. 8), and checks whether or not the next target temperature (Tn) is within a predetermined range (Tmin≦Tn≦Tmax) (step 7 in FIG. 8). If not, the next target temperature is reset to the current target temperature (Tn=Tc) (step 8 in FIG. 8). Otherwise, the next target temperature (Tn) is validated and is written into the control history table 80 to update the same. At the same time, the next target temperature (Tn) is included in the control project and the control project is written into the control history table 80 (steps 9 & 11 in FIG. 8) for controlling the air-conditioning apparatus 200 in accordance with the control project for realizing the next target temperature in the space.

Figure 9A:
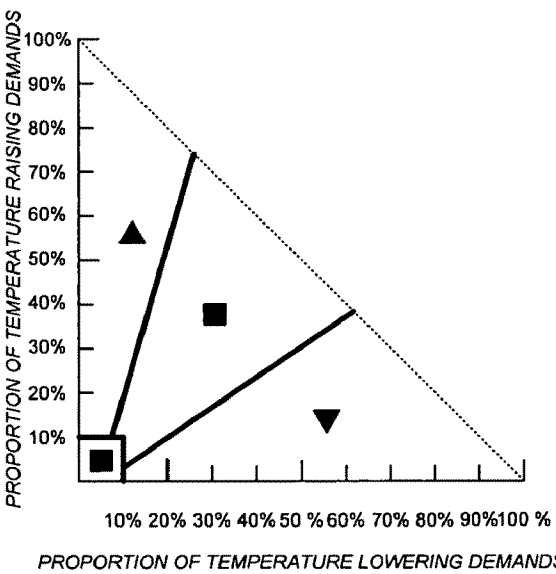
FIGS. 9A to 9C are graphs respectively illustrating criteria differing from different temperature settings for selecting the control project.
Figure 9B:
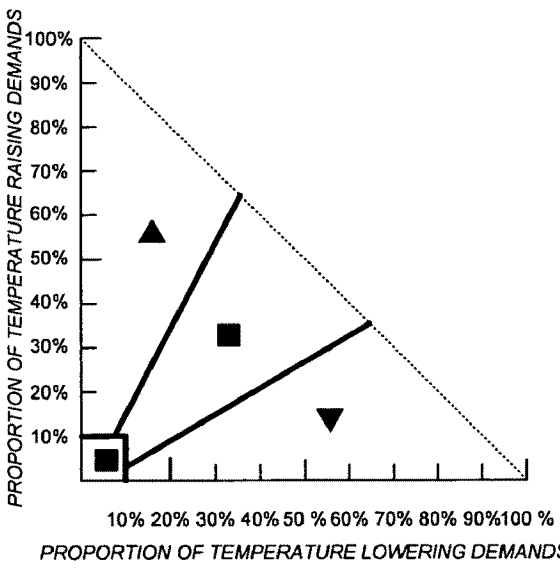
Figure 9C:
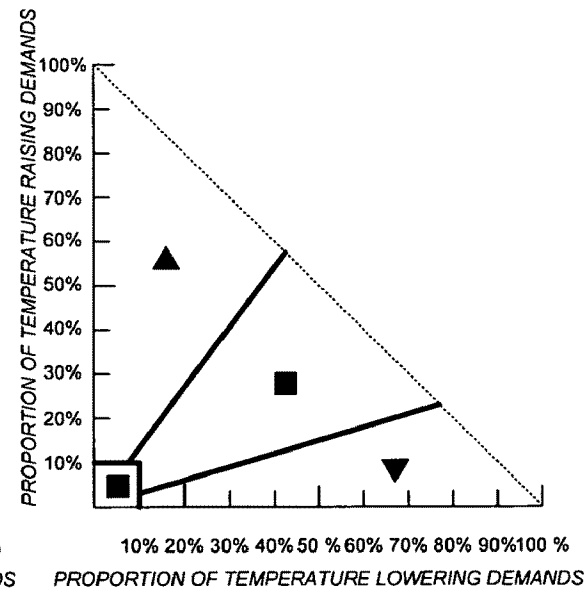

FIGS. 9A to 9C shows differing criteria or first and second references R1 and R2 which are relied upon to determine the next target temperature as discussed in the above. As seen from the figures, the references R1 and R2 differ from differing current target temperatures such that the gradient angles of the references decreases with the lowering of the current target temperature. That is, the temperature lowering zone "▼" becomes smaller as the current target temperature, i.e., the current room temperature is lowered, thereby reducing the chance of further lowering the temperature and therefore preventing excessive cooling. The same is true for the warming condition as the temperature raising zone "▲" becomes smaller as the current room temperature rises. Thus, the system can acknowledge a trend of varying the environment and realize a comfortable and energy-saving environmental control.

Figure 10A:
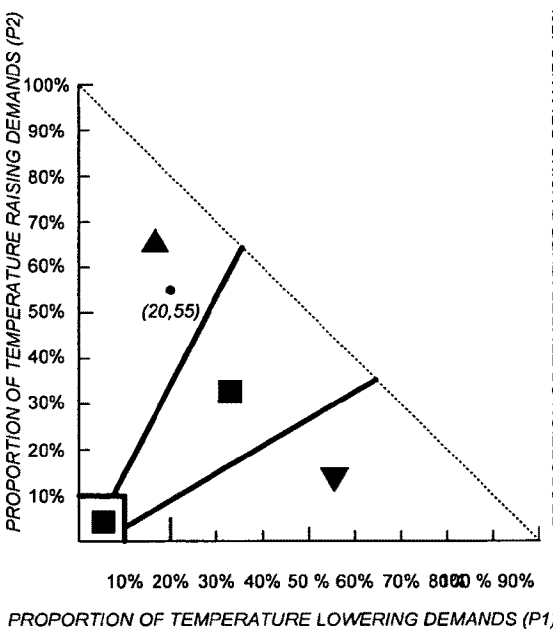
FIGS. 10A to 10C are graphs respectively illustrating a manner of modifying data of the demands for selecting the control project successively.
Figure 10B:
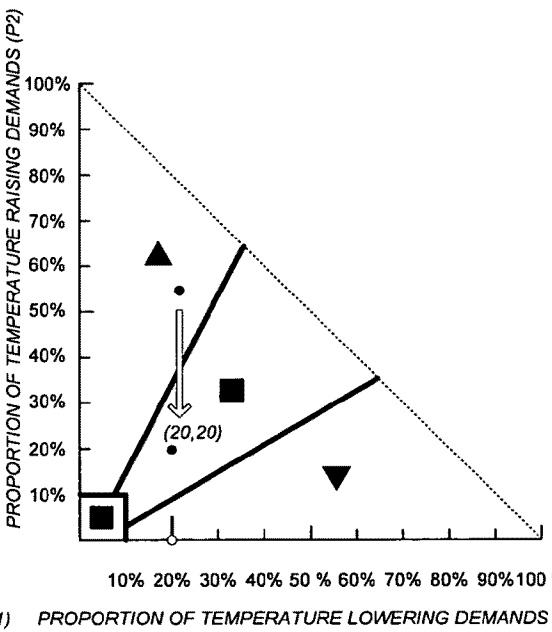
Figure 10C:
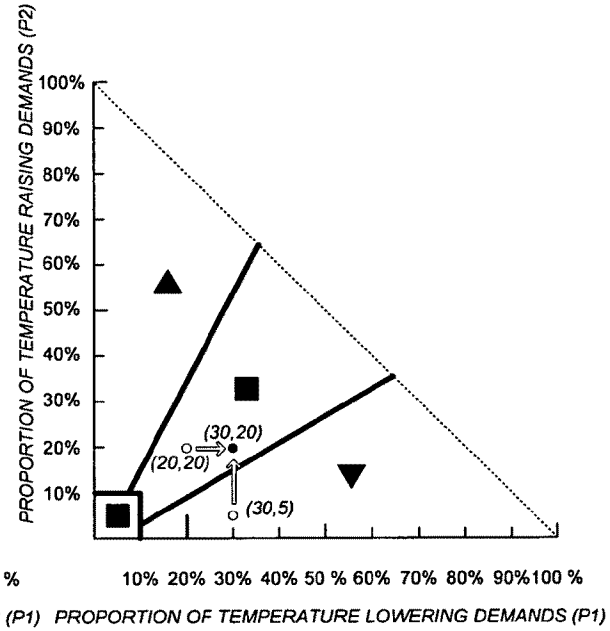
Figure 11:
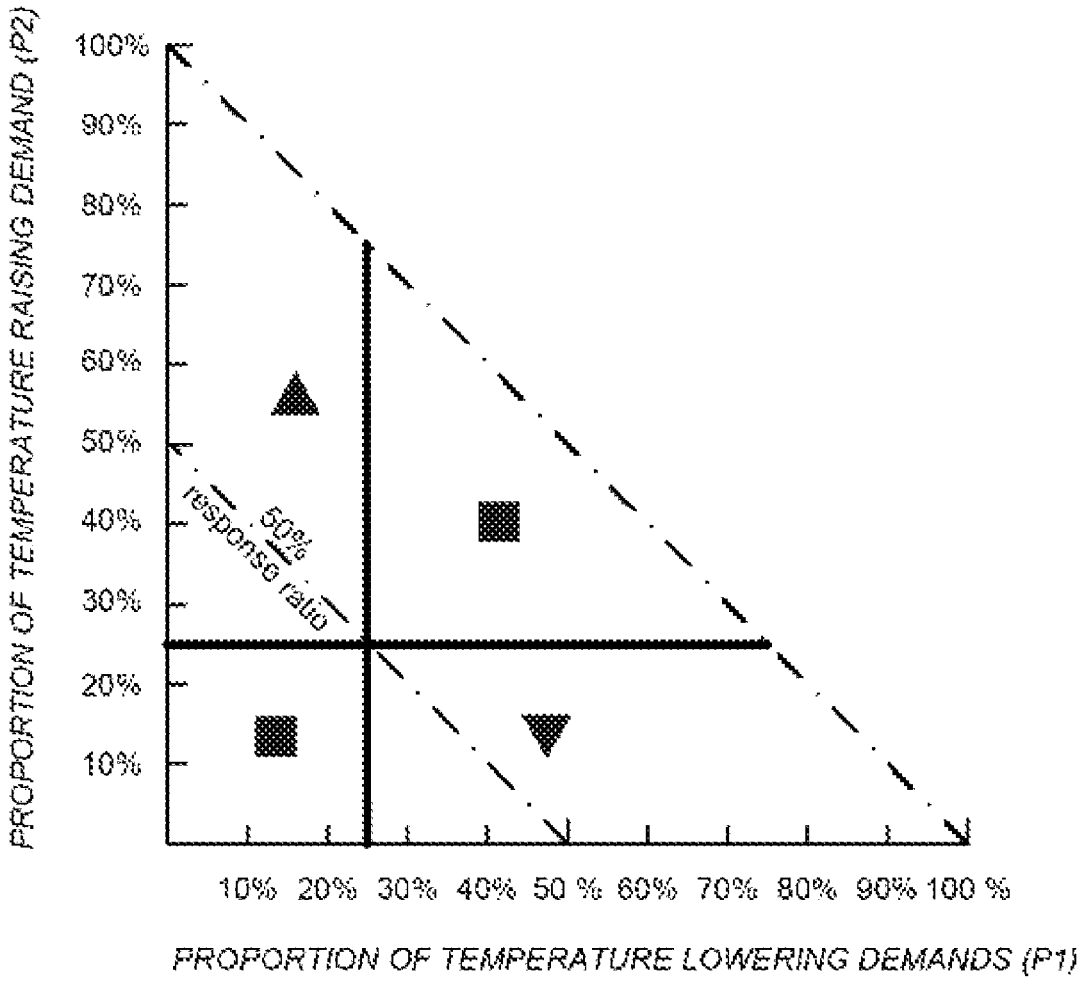
FIG. 11 is a graph illustrating a logical procedure relied upon in a prior art system to select the control project of controlling an air-conditioning apparatus.

Turning back to FIG. 5, the project composer 30 is configured to neglect the adopted demand (the temperature lowering demand in the illustrated case) in determining the next target temperature each time after the control project is updated. The neglect of the adopted demand is set to continue over a relatively long period, for example, 2 hours in order to avoid over-responses and assure moderate temperature control. However, the simple neglect would cause the non-adopted demands to be predominant in the next step of determining the control project, and therefore would result in the control of varying the temperature in the opposite direction. In order to avoid this undesired occurrence while aiming to give the moderate temperature control, the project composer 30 is given a function of modifying the demand ratio in a manner as shown in FIGS. 10A to 10C.

In detail, the project composer 30 gives a temporary proportion set composed of a temporary first proportion and a temporary second proportion each time the control project is determined. When the control project instructs to lower the temperature, the temporary first proportion and the second proportion are both set to be the previous second proportion. On the other hand, when the control project instructs to raise the temperature, the temporary first proportion and the temporary second proportion are both set to be the previous first proportion. In the illustrated instance of FIG. 10A where the control project of raising temperature is determined based upon the previous first proportion of 20% and the previous second proportion (55%), the temporary first and second proportions are both set to be 20% (the previous first proportion of the non-adopted demands), giving the temporary proportion set (20; 20), as shown in FIG. 10B. Subsequently, the project composer 30 compares the current first proportion and the current second proportion respectively with those (20, 20) of the corresponding temporary proportion set, and to give a modified proportion set which is a combination of a greater one of the current first proportion and said temporary first proportion, and a greater one of the current second proportion and the temporary second proportion. For example, when the current first and second proportions are determined respectively to be 30% and 5%, as shown in FIG. 10C, the modified proportion set is composed of the current first proportion of 30% and the temporary second proportion of 20%. The modified proportion set (30, 20) is stored in a modified proportion table 90 as shown in FIG. 3 and also FIG. 8 (step 10), and is relied upon for determining the next control project of raising, lowering, or keeping the temperature.

The temporary first and second proportions (20, 20) are decremented towards zero each time the control project is determined, i.e., at every one minute during the demand acquisition period DAP of FIG. 5. In this case, therefore, the temporary first and second proportions are reset to zero after the elapse of 20 minutes.

In the present embodiment, the systems is explained to reset only the adopted demands to zero each time the control project is made, the system may be configured to reset all the demands to zero each time the control project is made. Further, the initial target temperature at the very start of the system may be determined by any other method for prediction of thermal comfort available in the art.

The invention claimed is:

1. An environmental apparatus control system comprising:

an apparatus configured to a residential environment;

a demand collector configured to collect demands of changing said residential environments from residents present in said residential environment and to collect the total number of residents present in said residential environment on a regular basis, said demand including a first demand and a second demand which are opposed to each other;

a project composer configured to determine a control project of controlling said apparatus based upon said demands; said control project including a first project of controlling said apparatus to change said residential environment in one direction, a second project of controlling said apparatus to change said residential environments in the opposite direction, and a neutral project of controlling said apparatus to maintain said residential environments; and an apparatus controller configured to control said apparatus in accordance with said control project;

wherein said project composer is configured to have a first reference and a second reference each determined by a first proportion of a count of the first demands in said total number of the residents and a second proportion of a count of said second demand in said total number of the resident, said first reference and said second reference being different from each other, to obtain a current first proportion of the collected count of the first demands in said total number of the residents, and a current second proportion of the collected count of the second demands in said total number of the residents so as to give a current demand ratio, wherein said current demand ratio is a coordinate relationship of said current first proportion and said current second proportion, and to compare said current demand ratio with said first and second references so as to select one of said first, second, and neutral projects in accordance with a comparison result, wherein said first reference is defined by a predetermined first ratio, said predetermined first ratio being a coordinate relationship of the first proportion and the second proportion, and said second reference is defined by a predetermined second ratio, said predetermined second ratio being a coordinate relationship of the first proportion and the second proportion, and wherein said project composer is configured to select said first project when said current demand ratio is above said first reference, second project when said current demand ratio is below said second reference, and said neutral project when said current demand ratio is between said first reference and said second reference.

2. The system as set forth in claim 1, wherein said project composer is configured to determine a target parameter based upon the selected one of said first, second, and neutral projects, said target parameter being referred to by said apparatus controller for controlling said apparatus to adjust said residential environment in match with said target parameter, said target parameter being recorded in a control history table, said project composer is configured to shift at least one of said first reference and said second reference in a direction of reducing a chance of selecting said first project in a next step when the current target parameter is higher than the previous one, and of reducing a chance of selecting said second project in the next step when the current target parameter is lower than said previous one.

3. The system as set forth in claim 1, wherein said project composer is configured to have a third reference (R3) which is defined by a predetermined first lower limit (L1) of said first proportion (P1) and a predetermined second lower limit (L2) of said second proportion (P2), said project composer is configured to rely on said third reference (R3) to select said neutral project (S0) when said current first proportion (P1) is lower than said first limit (L1) and at the same time said current second proportion (P2) is lower than said second limit (L2).

4. The system as set forth in claim 1, wherein said project composer is configured to have a third reference which is defined by one of a predetermined first lower limit of said first proportion and a predetermined second lower limit of said second proportion, said project composer is configured to rely on said third reference to select said second project when said current first proportion is lower than said first limit or to select said first project when said current second proportion is lower than said second limit.

5. The system as set forth in claim 1, wherein said project composer is configured to provide a temporary proportion set composed of a temporary first proportion and a temporary second proportion each time one of said first and second projects is selected, said temporary first proportion being defined to be equal to the previous first proportion and said temporary second proportion being defined to be equal to said previous first proportion when said second project is selected, said temporary first proportion being defined to be equal to the previous second proportion and said temporary second proportion being defined to be equal to said previous second proportion when said first project is selected, said project composer is configured to compare the current first proportion and the current second proportion respectively with those of the corresponding temporary proportion set, and to give a modified proportion set which is a combination of a greater one of the current first proportion and said temporary first proportion, and a greater one of the current second proportion and said temporary second proportion, said modified proportion set being relied upon for selecting one of said first, second, and neutral projects, said project composer is configured to decrement said the temporary first and second proportions in said temporary proportion set towards zero each time said project composer selects the project.

* * * * *